United States Patent [19]

Voorheis

[11] Patent Number: 4,526,322

[45] Date of Patent: Jul. 2, 1985

[54] FLOW-REVERSING NOZZLE ASSEMBLY

[75] Inventor: James T. Voorheis, Essex Fells, N.J.

[73] Assignee: Voorheis Industries, Inc., Fairfield, N.J.

[21] Appl. No.: 362,224

[22] Filed: Mar. 26, 1982

[51] Int. Cl.[3] ..... B05B 7/10

[52] U.S. Cl. ..... 239/404; 239/406; 239/425; 239/433

[58] Field of Search ..... 239/404, 405, 406, 399, 239/424.5, 425, 433, 403

[56] References Cited

U.S. PATENT DOCUMENTS

| | | | |
|---|---|---|---|
| 1,669,810 | 5/1928 | Clapham | 239/405 |
| 2,149,115 | 2/1939 | De Foe et al. | 239/405 |
| 3,450,349 | 6/1969 | Hamon | 239/433 |
| 4,269,358 | 5/1981 | Ohtani et al. | 239/425 |

FOREIGN PATENT DOCUMENTS

| | | | |
|---|---|---|---|
| 912611 | 4/1954 | Fed. Rep. of Germany | 239/399 |
| 1008835 | 5/1952 | France | 239/405 |

*Primary Examiner*—Jeffrey V. Nase
*Assistant Examiner*—Michael J. Forman
*Attorney, Agent, or Firm*—David A. Jackson; Daniel H. Bobis

[57] ABSTRACT

A burner nozzle assembly is disclosed for atomizing liquid fuel at lower emission velocities, and comprises an axially extended nozzle body and a nozzle cap mounted forwardly thereon, the nozzle cap and nozzle body cooperating to define a flow reversing fluid path for the liquid fuel, to cause the fuel to move essentially countercurrent to its initial direction of flow, and to the flow of an auxiliary fluid disposed in an outer coaxial conduit. The reversal of flow of the liquid fuel, promotes a collision between it and the auxiliary fluid, to facilitate thorough atomization, without the need for increase in emission velocities, that results in higher fuel consumption and reduced per capita fuel utilization and heat radiation. The nozzle is adapted to operate in a variety of burner assemblies, including conventional burner guns, and is of simple construction.

25 Claims, 9 Drawing Figures

FLOW-REVERSING NOZZLE ASSEMBLY

BACKGROUND OF THE INVENTION

1. Field of the Invention

The present invention relates to nozzle assemblies for fluid atomization, and particularly to nozzle assemblies useful in fuel burning apparatus to accomplish the atomization of the fuel in an auxiliary fluid such as air or steam.

2. Description of the Prior Art

Liquid fuel burning devices operating by the combustion of atomized liquid fuel are well known. In particular, a variety of such devices have long been in use in connection with oil burners, as it is equally well recognized that efficient fuel combustion is achieved when the liquid fuel is disposed in an extremely finely divided state of minute droplets, to maximize flame contact. Generally, fuel atomization is conducted under elevated pressures, with the pressure of the atomizing medium, be it air or steam, maintained at a constant differential pressure residing above the fuel pressure, while the pressure of the fuel is varied depending upon the operational requirements of the burner system.

In the past, burner nozzles have utilized a variety of means for effecting atomization, ranging from single to multiple mixing nozzles wherein the respective conduits of the fuel and auxiliary fluid are brought together at a variety of angles with respect to each other, to achieve atomization. For example, U.S. Pat. No. 777,680 to Lassoe et al. discloses an oil burner with coaxially disposed conduits, an oil tube disposed within a steam tube. The oil tube terminates in a reduced section that opens into a chamber into which feed a multiplicity of reduced diameter conduits carrying the steam from the steam tube. Thus, oil and steam intermix and atomization takes place, and the resulting atomized mixture is discharged into the combustion chamber.

A variety of differing nozzle elements are shown and disclosed in the following U.S. Patents: U.S. Pat. No. 4,002,297 to Pillard; U.S. Pat. No. 3,739,990 to Triggs; U.S. Pat. No. 3,362,647 to Davis, Sr. et al.; U.S. Pat. No. 3,130,914 to Carkin et al.; and U.S. Pat. No. 3,072,334 to McKenzie. All of the foregoing patents employ a nozzle element that provides for mixture and atomization of the fuel and auxiliary fluid, to take place at the junction of the respective conduits, in which the respective conduits are either concurrent in their flow or, at most, flow transversely toward each other.

In similar fashion, U.S. Pat. No. 4,195,780 to Inglis discloses a nozzle construction for the metered flow of a fluid under pressure, wherein the fluid is introduced into an outer fluid flow in essentially concurrent relationship thereto.

U.S. Pat. No. 1,669,810 to Clapham discloses an oil burner gun having a deflector at the end of a fuel inlet pipe, that has a cup-shaped recess, that appears to direct incoming fuel radially outward into an oncoming stream of air. The direct deflection of the Clapham device, however, has its drawbacks, as streams of fuel may, for example, emerge that are insufficiently atomized, and are inadequately burned. Also, nonuniform fuel atomization can cause high velocity streaks of burning fuel that can damage furnace linings by causing impingement.

One of the difficulties that attends the efficient operation of fuel burning devices, and particularly oil burners, relates to the increased velocities at which such atomization burning devices must operate. Particularly at the present time, wherein fuels of lower grade, with higher residual nonvolatile components, presents problems of combustion efficiency, fuel cost and air pollution. In particular, the heavier fuels containing these nonvolatile components, are more difficult to burn, and the unburned fractions tend to coat the burners and form carbon deposits that can clog the burners and further reduce their operating efficiency. Likewise, the release of unburned fuel fractions into the air, causes an air pollution problem requiring substantial expenditures of time and resources to abate. It has therefore been determined that the only way in which such fuels may be efficiently burned, is to achieve maximum atomization at increased fluid pressures, to effect the maximum dispersion of the fuel droplets. This approach, however, has its drawbacks in that burner operation frequently varies from maximum to lower capacities, and with the use of increased fluid pressures, more fuel may be burned and therefore, used, than is necessary to achieve fuel efficiency while minimizing the adverse effects mentioned above.

Desirably, fuel atomization should be achieved at lower emission velocities, to maximize combustion and to reduce residual unburned fuel so as to maximize the heat utilization and recovery. At present, however, attempts to achieve efficient fuel atomization at lower pressures and emission velocities, have been unsuccessful, with the adverse results mentioned earlier herein.

Accordingly, it is desirable to achieve maximum fuel atomization at lower emission velocities, to provide a means for efficient fuel consumption in the instance of reduced burner operational requirements.

SUMMARY OF THE INVENTION

In accordance with the present invention a burner nozzle assembly for atomizing liquid fuel at lower emission velocities is disclosed, which comprises an axially extended nozzle body and a nozzle cap mounted forwardly on the body portion, the nozzle cap and body cooperating to define a flow reversing fluid path for the fuel, to cause the fuel to move essentially countercurrent to the direction of flow of an auxiliary fluid, whereby thorough fuel atomization takes place at lower emission velocities in an impact zone annularly displaced from the nozzle assembly. The thus atomized fuel mixture can proceed in a direction of flow of the atomizing fluid, past the nozzle assembly, and toward the combustion chamber.

The body portion of the present burner nozzle assembly defines at least one central axial bore extending from an inlet port and opening adjacent its forwardmost terminus into at least one transverse passage that extends generally radially outward to register with the exterior of the body portion. The transverse passage registers with the exterior of the body at an acute angle to its circumference, to promote unidirectional helical motion to the resulting fuel spray that forms a 360° cone, as it exits from the present nozzle assembly.

The body portion defines a reduced diameter forward end, to which the cap may be removably attached. The cap defines an inward taper or bevel on its forward outer surface. A sleeve extends axially rearwardly from the cap, and is adopted to reside in annular displacement from the reduced diameter end of the body portion, to define a countercurrent fluid passageway in registry with the transverse passageway, to facilitate the reversal of flow of the liquid fuel. The sleeve of the cap terminates in spaced apart relation to the outer surface of the body to permit the liquid fuel to leave the countercurrent fluid passageway. The terminal rim of the sleeve preferably has a slight outer bevel, to prevent unwanted fuel and carbon deposits.

The cone of spinning liquid fuel emerging from the present nozzle assembly travels into essentially head-on collision with the auxiliary fluid medium that may optionally be spinning as well, and improved fuel atomization thus takes place in an impact zone that is annularly removed from the outer surfaces of the nozzle assembly.

In an alternate embodiment, the body portion includes at least one coaxial telescopically received inlet conduit for delivery of a second fuel to the countercurrent fluid passageway. Plural transverse passageways are defined, that are axially spaced apart, to provide individual paths of travel for the respective fuels, and the inlet conduit defines a circular fluid wall adjacent its inner terminus that is positioned between the transverse passageways to assure separation of the streams of fuel as they leave the body portion. The respective streams may merge as plural fluid helices in the countercurrent fluid passageway. This construction enables a single burner nozzle to deliver separate fuels for concurrent atomization by a common auxiliary fluid.

The present nozzle assembly may be utilized in a variety of conventional burner applications and is therefore adaptable for domestic and industrial fuel combustion applications. In the instance where the present nozzle assembly is utilized in a conventional burner gun, with a fuel pressure piston assembly, the transverse passageways may be defined by one or more axially directed slits, to permit the piston to modulate the opening between the central bore and the transverse passageways.

The present burner nozzle assembly is of simplified construction and, by permitting the improved atomization of fuel at reduced emission velocities, contributes to improved fuel efficiency and reduced air pollution.

Accordingly, it is a principal object of the present invention to provide a means for atomizing fuel, that permits atomization to take place at reduced emission velocities.

It is a further object of the present invention to provide a means as aforesaid that is of simplified construction and maintenance.

It is a yet further object of the present invention to provide an atomization nozzle assembly as the aforesaid means, that is of universal application for the atomization of combustible fluids.

It is a yet further object of the present invention to provide a fluid atomizing nozzle assembly as aforesaid that is useful for both domestic and industrial fuel burning applications.

Other objects and advantages will become apparent to those skilled in the art from a consideration of the ensuing description which proceeds with reference to the following illustrative drawings.

DETAILED DESCRIPTION

Figure 1:
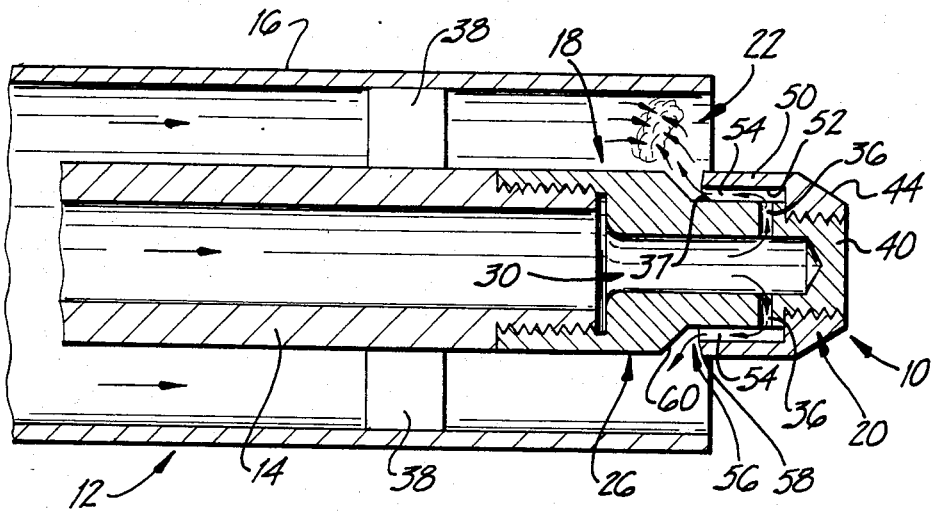
FIG. 1 is a side sectional, partly fragmentary view of a nozzle assembly in accordance with the present invention.

Referring now to the FIGURES, wherein like numerals designate like parts throughout, and initially to FIG. 1, an atomizing nozzle assembly 10 is shown installed in a fragmentarily depicted liquid fuel atomizing burner 12. It is to be understood, that while the nozzle assembly of the present invention will be explained hereinafter and illustrated with reference to fuel burning apparatus, and particularly atomizing fuel burners, the present nozzle assembly is susceptible of a variety of diverse applications, in instances wherein atomizatiqn of diverse fluids is desired. The present invention, should not therefore be limited to the specific illustrations presented herein.

The portions of burner 12 illustrated fragmentarily in FIG. 1, comprise coaxial conduits 14 and 16, that transport, respectively, the combustible fuel, such as conventional fuel oil, and an auxiliary atomizing fluid, such as air or steam. Inner conduit 14 is conventionally attached to various nozzle means, by which the fuel may egress into turbulent contact with the air or steam moving in concurrent fashion through outer conduit 16.

As previously discussed, conventional fuel atomization devices operate by converging the respective fluid flows at various acute angles with respect to each other, with the flow of the respective fluids traveling in a substantially concurrent direction. Also, such devices usually employ nozzles with individual orifices that utilize a high velocity auxiliary fluid, such as steam. This construction and operation has been found to cause streaks of atomized fuel that may hit the furnace and other interior areas, and cause damage to the furnace.

By contrast, the nozzle assembly 10 of the present invention utilizes a countercurrent helical flow of fuel that offers improved flame retention and reduced streaking. Also, improved fuel efficiency at reduced operational levels, improved heat radiation and reduced undesirable effluent and contamination are likewise obtained.

Referring further to FIG. 1, nozzle assembly 10 comprises a nozzle body 18 that is preferably axially extended as shown, and a nozzle cap 20 that is mounted forwardly thereon. Nozzle body 18 and nozzle cap 20 cooperate to define a flow reversing fluid path for fuel directed through nozzle assembly 10, to cause the fuel to move essentially countercurrent to the direction of flow of the auxiliary fluid traveling in the direction shown by the arrows, within conduit 16. The fluid path offered by nozzle assembly 10 is illustrated by the arrows therewithin, and can be seen to promote virtual head-on collision between the respective fluids in an area that may be considered an impact zone, that is located within conduit 16, and annularly removed from conduit 14. This impact zone is shown schematically at 22 in FIG. 1, and represents a theoretical location for the collision between the respective fluids.

In the instance where conduits 14 and 16, and nozzle assembly 10 are all essentially cylindrical, impact zone 22 may occupy an approximately toroidal area about nozzle body 18. In addition to the improved atomization conferred by this construction, other variations in the construction of both the nozzle assembly 10 and the portion of burner 12 illustrated in FIG. 1, may be made, that are believed to enhance atomization of the fuel. These further modifications will be discussed later on herein.

NOZZLE BODY

Figure 2:
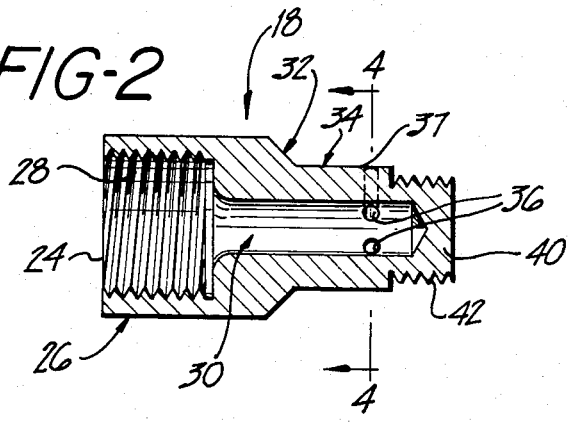
FIG. 2 is a side sectional view of the body portion of the nozzle of FIG. 1.

Referring to FIGS. 1 and 2, nozzle body 18 in a first embodiment defines an inlet port 24 for the reception of liquid fuel to be atomized. As illustrated, inlet port 24 is disposed at the upstream end of nozzle 18, and may receive the forward end of a conduit carrying liquid fuel, such as conduit 14 illustrated herein. Body 18 is enlarged at its upstream end, and defines a larger diameter upstream portion 26, that may be adapted for fluidtight engagement with conduit 14 as shown. In such instance, for example, upstream portion 26 may define an increased internal diameter adjacent inlet port 24, and may, if desirable, be provided with threads 28 for the removable threaded engagement of corresponding threads provided on conduit 14.

A central axial bore 30 extends longitudinally from inlet port 24 to a terminus adjacent the opposite or downstream end of nozzle body 18. The internal diameter of central bore 30 may vary, and, as illustrated, may be slightly less than that of conduit 14. The exact relationship of the respective diameters however is not strictly critical, and may vary in accordance with the present invention.

Central bore 30 is axially aligned with the corresponding passageway defined in conduit 14, and permits the fuel to continue its original line of travel. Nozzle body 18 changes external diameter along the length of travel of central bore 30, and first gradually tapers as illustrated along intermediate tapered portion 32, and thereafter assumes the smaller size of reduced diameter downstream portion 34. Tapered portion 32 and reduced diameter downstream portion 34 cooperate as described later on herein, with nozzle cap 20, to provide a flow reversing fluid passage that facilitates the impact between the atomizing fluid and the liquid fuel. Intermediate tapered portion 32 may be a bevel disposed between portions 26 and 34, and in the instance where nozzle body 18 is essentially cylindrical, portion 32 will appear frusto-conical in shape.

Reduced diameter downstream portion 34 is preferably cylindrical in outer shape, and defines one or more transverse passages 36, that are preferably disposed adjacent the forwardmost terminus of central bore 30, and extend from bore 30 into registry with the outer surface 37 of reduced diameter downstream portion 34, to enable the liquid fuel in bore 30 to travel radially outward. Preferably, more than one transverse passage 36 may be provided, and may be regularly spaced, to offer a symmetrical, uniform distribution of fuel from central bore 30. The exact number of passages 36 may vary, and, for example, as illustrated in FIGS. 2 and 4 herein, four passages 36 may be utilized.

The exact disposition of passages 36 with respect to central bore 30 may likewise vary, and, as shown generally in FIG. 1 and FIG. 8 described later on herein, passages 36 may radiate directly from the axial center of central bore 30, outward to the outer surface 37 of reduced diameter portion 34. Also, as illustrated in FIGS. 2 and 4, transverse passages 36 may extend in a tangential radiating fashion from the inner surface of bore 30, and with respect thereto, into communication with outer surface 37.

One of the important features of the present nozzle assembly is that the fuel transferred into the countercurrent flow is given a unidirectional helical spin. This serves to enhance fuel atomization in collision with the auxiliary fluid, as the spin tends to give the fuel a thinner film character. This is important, as the incoming fuel is usually viscous and difficult to disperse.

Figure 4:
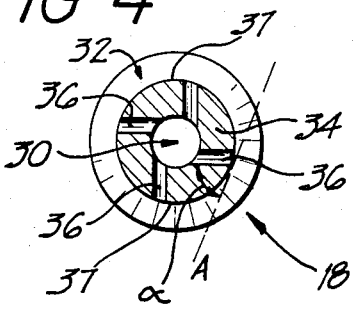
FIG. 4 is a front sectional view taken through Line 4—4 of FIG. 2.
Figure 7:
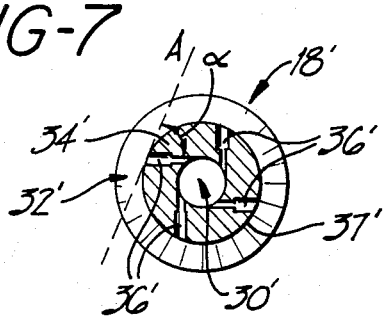
FIG. 7 is a front sectional view taken through Line 7—7 of FIG. 6, illustrating the transverse passageways in accordance with an alternate embodiment of the invention.
Figure 8:
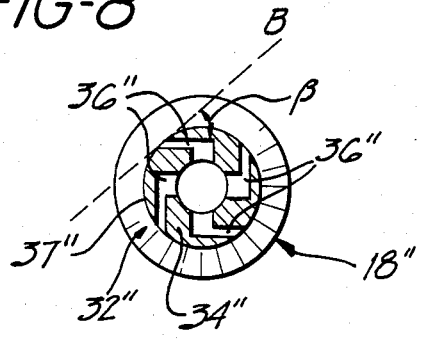
FIG. 8 is a front sectional view illustrating a further alternate configuration of the transverse passageways of the invention.

Referring to FIGS. 4, 7 and 8, transverse passages 36 are positioned to define at least along a portion of their length, an acute tangent angle to the circumference of outer surface 37, to assure that a single direction helical spin will be imparted to the liquid fuel. Thus in FIGS. 4 and 7, the direction of respective passages 36 and 36' lies at an acute angle $\alpha$ taken with respect to Line A representing the tangent line taken at the point of emergence of passages 36 and 36' from respective outer surfaces 37 and 37'. An alternate configuration is shown in FIG. 8, as passages 36'' commence in perfect radial fashion but then each change direction, as illustrated, to terminate at an acute angle $\beta$ in relation to Line B, representing the corresponding tangent line to the circumference of outer surface 37''.

Figure 5:
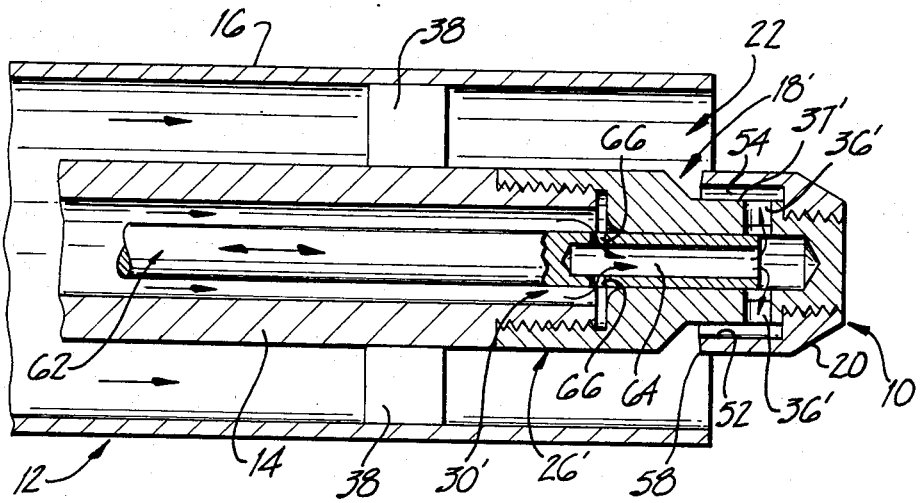
FIG. 5 is a side sectional view showing a burner nozzle assembly in accordance with an alternate embodiment of the present invention.
Figure 9:
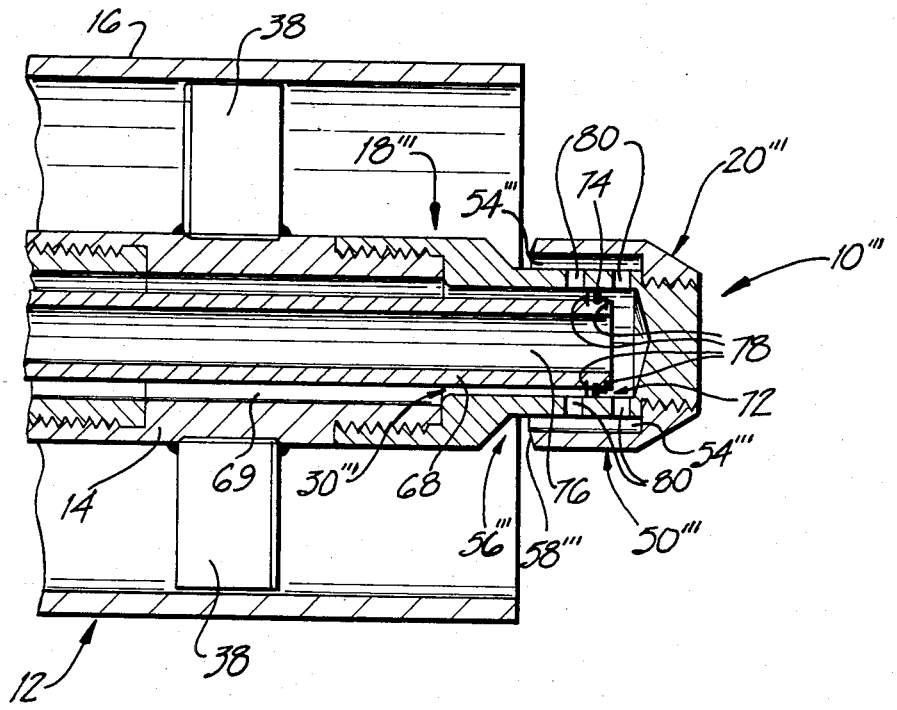
FIG. 9 is a side sectional view showing a burner nozzle assembly in accordance with another embodiment of the invention.

Also, as illustrated in FIGS. 1, 5 and 9, a series of uniformly disposed vanes 38 may be regularly disposed between the inner wall of conduit 16 and the outer wall of conduit 14, to impart a similar helical spin to the atomizing fluid prior to its impact with the liquid fuel. Vanes 38 may be similarly variant in number, and may be essentially planar structures disposed at various acute angles with respect to the longitudinal axis of conduits 14 and 16, in much the same fashion as a fan propeller. The exact angle of disposition of vanes 38 is not critical, and, for example, the vanes may assume a 55° angle with respect to the axis of travel of conduits 14 and 16. Naturally, the invention is not limited to this particular angle, and may vary within its spirit or scope.

Referring further to FIG. 2, reduced diameter downstream portion 34 defines at its forwardmost terminus a wall 40 that defines the end of bore 30. Means for attachment of nozzle cap 20 are provided at this point, and, as illustrated, downstream portion 34 may be further reduced in diameter, and provided with threads 42.

NOZZLE CAP

Figure 3:
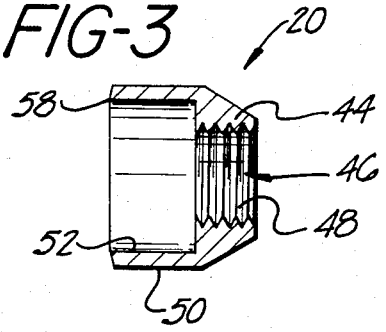
FIG. 3 is a side sectional view of the cap portion of the nozzle assembly of FIG. 1.

Nozzle cap 20 is illustrated individually in FIG. 3. Nozzle cap 20 may be generally cylindrical, and may define a forward beveled nose 44 that, while not expressly provided for such purpose, may assist in the convergence of the annular flow of atomized fuel as it enters the combustion chamber not shown herein. As discussed above, nozzle cap 20 may be mounted upon the forwardmost portion of nozzle body 18 by means of a forward bore 46 having threads 48 sized for fluidtight engagement with threads 42.

Cap 20 extends rearward from the area of nose 44 and defines an essentially cylindrical sleeve 50 with an inner surface 52, that, as shown in FIG. 1, is adapted to cooperate with adjacent outer surface 37 of reduced diameter portion 34, to define a flow reversing fluid passage 54, shown in FIG. 1. Passage 54 is essentially parallel to bore 30, and thus represents a virtually complete reversal of flow direction for liquid fuel originating from bore 30.

Passage 54 terminates at an opening 56, that may be ring-like as illustrated. The rear edge 58 of sleeve 50, may be slightly forwardly beveled to an angle, for example, of up to 10°, to avoid capillary migration of fuel that results in fuel deposits and carbon buildup. In particular, edge 58 may have a 7° bevel, though the exact angle is not critical to the present invention.

Another feature of the invention is that sleeve 50 is preferably of an axial length sufficient to enable the spray of fuel that develops in passage 54 to form a 360° cone as it emerges from opening 56. In this way, maximum atomization and uniformity will be achieved. The fuel emerging from opening 56 is thus in the form of a thin conical film, as it moves toward impact with the oncoming atomizing air.

The nozzle assembly of the present invention may be constructed from materials well known for burner applications, by techniques such as machining, casting and the like. The liquid fuels that may be atomized are also well known, and would comprise fuels such as heavy fuel No. 6, liquid butane, low boiling gasoline, naphtha, various tars and alcohols, and the like. Likewise, the auxiliary fluid, comprising the fluid that would assist in the atomization of the liquid fuel, may be simply atmospheric air, or other combustion promoting gases, steam, either alone, or in combination with combustion additives, liquid effluents and other materials suitable for combustion derived from either the primary or recirculating means.

OPERATION

Referring again to FIG. 1, an illustrated manner of operation may comprise the concurrent travel of a liquid fuel within conduit 14, while an auxiliary atomizing fluid travels through conduit 16. The liquid fuel in conduit 14 is directed into central axial bore 30, from which it is directed radially outward through transverse passages 36, and into flow reversing passage 54. Upon emerging from exit port 56, the liquid fuel moves radially outward into countercurrent, head-on collision with the atomizing fluid, within the area of conduit 16 comprising impact zone 22. Atomization thus takes place, and the forward velocity of the auxiliary fluid within conduit 16 drives the thus atomized liquid fuel in the downstream direction past nose 44 and into the combustion chamber, not shown.

One of the applications of nozzle assembly 10 includes its disposition within a device well known as a burner gun. Such a device is illustrated in my U.S. Pat. No. 4,285,664, the pertinent disclosure of which is incorporated herein by reference. Thus, referring now to FIG. 5, the forwardmost end of a burner gun construction is illustrated, and includes inner coaxial conduit 14, and outer coaxial conduit 16, as shown in FIG. 1, for their like purpose. The construction of FIG. 5 includes, however, a piston 62 having an adjustable axial travel, that extends through conduit 14, and into bore 30'. Piston 62 defines an outer diameter such that an annular space exists between the outer surface of piston 62 and the inner surface of conduit 14, to permit the travel of liquid fuel therebetween. Piston 62, however, is closely dimensioned to bore 30'. Piston 62 is provided with a forward hollow end 64, and a plurality of inlet openings 66 at the rearmost end of hollow 64, communicate with the outer surface of piston 62, to permit fuel to pass thereinto.

Figure 6:
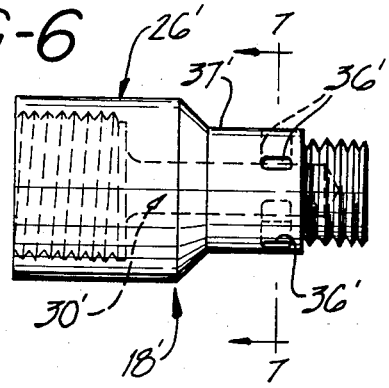
FIG. 6 is a side elevational view partly in phantom illustrating the body portion of the nozzle assembly of FIG. 5.

Nozzle assembly 10 is the same as illustrated in FIG. 1, with the exception that transverse passages 36' comprise longitudinally elongated slots, illustrated better in FIG. 6. Slots are provided in place of the conventional substantially cylindrical and smaller passages of the embodiment of FIGS. 1-4, as the burner gun operates by adjustment of the piston 62 to increase or reduce flow of the liquid fuel passing through conduit 14, and emerging from the nozzle assembly 10. It can thus be visualized that, as the piston 62 is adjusted forward to increase the extent of obstruction of slots 36', the liquid fuel seeking to travel from the hollow 64 through passages 36' is placed under greater restriction, and flow is decreased.

Referring now to FIG. 7, passages 36' may be positioned in tangential radiating disposition with respect to bore 30' in similar fashion to the illustration of FIG. 4, to assist in imparting spin to the liquid fuel. In addition, the passages 36' may present an increased length to extend piston travel.

In similar fashion to the apparatus of FIG. 1, the oil gun of FIG. 5 may utilize a plurality of vanes 38 canted at various angles with respect to the line of travel of the auxiliary fluid, to assist in imparting some spin thereto. Likewise, an annulus may be positioned adjacent the larger diameter upstream portion 26' of the nozzle body 18', to enhance toroidal eddies of the auxiliary fluid adjacent the impact zone, to further promote atomization. The annulus and its construction are the subject of my earlier mentioned U.S. Pat. No. 4,285,664, and the disclosure thereof is likewise incorporated herein by reference.

In accordance with a further embodiment of the present invention, the burner nozzle assembly may be modified to permit plural, different fuels to be atomized by a common stream of atomizing air. Thus, referring now to FIG. 9, a nozzle assembly 10''' shown which corresponds generally in construction to the nozzle assemblies previously discussed. Nozzle assembly 10''' differs in the construction of nozzle body 18'''. Nozzle body 18''' defines plural, coaxially disposed fluid conduits for the concurrent delivery of the differing combustible fuels. In particular, a secondary inlet conduit 68 is shown received within central bore 30''', in spaced apart relation thereto, to define an outer fluid channel 69 therebetween for the passage of a first combustible fuel. Conduit 68 defines a secondary concentric bore 70 that serves as an inner fluid channel for the passage of a second combustible fuel. The respective fuels travel through axially spaced apart transverse passageways 80 and enter common flow reversing fluid passage 54''' similar axially spaced relation to each other. In this way, plural helical fluid sprays may develop within passage 54''', and may emerge concurrently through opening 56''', to meet oncoming atomizing air, in the manner described earlier herein.

The respective fuels are maintained apart from each other until they mix within fluid passage 54''', by a transversely extending fluid-tight wall or partition 72. Partition 72 may be prepared in a variety of ways, and, as illustrated briefly herein, may comprise a resilient O-ring 74 retained in position along the outer surface 76 of secondary inlet conduit 68, by paired retainer rings 78, that may, for example, be disposed within parallel grooves provided in outer surface 76, in a manner known in the art.

The particular resilient material used to prepare O-ring 74 may vary, and, for example, may comprise a high temperature elastomeric material such as KALREZ® manufactured by E.I. duPont DeNemours & Co., Inc. Naturally, the exact construction of partition 72 may vary, depending upon the dimensions and materials from which the burner nozzle assembly 10''' is prepared, and the exact number of secondary conduits 68 utilized.

In the above connection, it should be noted that the embodiment of FIG. 9 contemplates a plurality of conduits 68, so that three or more diverse fuel streams may be united for concurrent atomization. Accordingly, the invention should not be construed as limited to the illustration of FIG. 9, but should be interpreted as embracing the foregoing variations within its spirit and scope.

Referring again to FIG. 9, the remainder of the structural features of nozzle 10''' may vary in accordance with those comparable features discussed with reference to FIGS. 1–8, earlier. Thus, for example, passageways 80 may assume the variations in configuration illustrated with reference to FIGS. 4, 7 and 8, and nozzle 20''' preferably utilizes a sleeve 50''' having a forwardly tapered edge 58'''. Likewise, a plurality of vanes 38 may be provided between conduit 16 and conduit 14, to impart a spin to the oncoming atomizing air, to further enhance the atomization in contact with the spinning fuel exiting from opening 56'''.

It is understood that the invention is not limited to the illustrations described and shown herein, which are deemed to be merely illustrative of the best modes of carrying out the invention, and which are suitable of modification of form, size, arrangement of parts and details of operation. The invention rather is intended to encompass all such modifications which are within the spirit and scope and defined by the claims.

What is claimed is:

1. A burner nozzle assembly for receiving and transporting liquid fuel for atomization prior to combustion, comprising:

A. a nozzle body having an outer surface, at least one inlet port, at least one axially extended central bore communicating with said inlet port for transporting said liquid fuel therein in a first direction, and at least one transverse passage fluidly connecting each said central bore and the outer surface of said nozzle body and defining an acute tangent angle to the point of its emergence on the outer surface of said nozzle body for imparting a unidirectional spin to said liquid fuel exiting at said point of emergence;

B. a nozzle cap mounted on said nozzle body, and located distally with respect to said inlet port; and C. a flow reversing fluid passage defined by said nozzle cap and the outer surface of said nozzle body adjacent to said at least one transverse passage for reversing the direction of flow of said liquid from the direction of flow thereof within said bore, and said flow reversing fluid passage having an opening for the egress of said liquid fuel from said nozzle assembly such that the direction of travel of said liquid fuel emerging from said nozzle assembly is essentially opposite to that of a second, atomizing fluid, traveling adjacent said nozzle assembly, to provide a collision between said fuel and said atomizing fluid, resulting in improved atomization of said liquid fuel, at reduced emission velocities and fluid pressures.

2. The nozzle assembly of claim 1 wherein said nozzle body is axially elongated, each said inlet port is adapted for fluid-tight attachment to a conduit for said liquid fuel and each said transverse passageway is located downstream and distal with respect to said inlet port.

3. The nozzle assembly of claims 1 or 2 wherein each said central axial bore defines an increased diameter adjacent said each respective inlet port, for the reception of a conduit for said liquid fuel.

4. The nozzle assembly of claim 3 wherein each said central axial bore defines threads for threaded engagement with said liquid fuel conduit, along said increased diameter.

5. The nozzle assembly of claims 1 to 2 wherein:

A. each said inlet port is defined within a larger diameter upstream portion adapted for attachment to a conduit for said liquid fuel;

B. said nozzle body includes a reduced diameter downstream portion adapted to receive said nozzle cap;

C. an intermediate tapered portion is disposed between said upstream portion and said downstream portion; and D. said intermediate tapered portion and said downstream portion cooperate with said nozzle cap to further define said flow reversing fluid passage.

6. The nozzle assembly of claim 5 wherein each said central axial bore defines an increased diameter adjacent each respective inlet port, for the reception of a conduit for said liquid fuel.

7. The nozzle assembly of claim 6 wherein each said central axial bore defines threads for threaded engagement with said liquid conduit, along said increased diameter.

8. The nozzle assembly of claim 5 wherein said nozzle cap defines a forward tapering beveled nose, and a rearwardly extending sleeve annularly disposed with respect to the outer surface of said nozzle body, and said flow reversing fluid passage being defined by said sleeve and said outer surface.

9. The nozzle assembly of claim 8 wherein said sleeve extends axially upstream in substantially parallel, spaced apart relation to the outer surface of said reduced diameter portion, and at the upstream terminus thereof, cooperates with said intermediate tapered portion to define said opening.

10. The nozzle assembly of claim 9 wherein said sleeve has an axial length no greater than that of said reduced diameter portion.

11. The nozzle assembly of claim 5 including at least two transverse passages.

12. The nozzle assembly of claim 11 wherein said transverse passages are regularly spaced with respect to each other.

13. The nozzle assembly of claim 5 wherein each said transverse passage comprises an axially elongated slot.

14. The nozzle assembly of claim 1 or 2 wherein said nozzle cap is screw threadedly attached to said nozzle body.

15. The nozzle assembly of claims 1 or 2 wherein said nozzle cap defines a forward tapering beveled nose, and a rearwardly extending sleeve annularly disposed with respect to the outer surface of said nozzle body, and said flow reversing fluid passage being defined by said sleeve and said outer surface.

16. The nozzle assembly of claim 15 wherein each said transverse passage comprises an axially elongated slot.

17. The nozzle assembly of claim 15 including at least two transverse passages.

18. The nozzle assembly of claim 17 wherein said transverse passages are regularly spaced with respect to each other.

19. The nozzle assembly of claims 1 or 2 including at least two transverse passages.

20. The nozzle assembly of claim 19 wherein said tranverse passages are regularly spaced with respect to each other.

21. The nozzle assembly of claims 1 or 2 wherein each said transverse passage comprises an axially elongated slot.

22. The nozzle assembly of claim 1 wherein:

A. said nozzle body includes at least one secondary inlet conduit received in spaced-apart relation within said at least one said central bore, each said central bore and each respective secondary conduit cooperating to define a first separate channel, and each said secondary conduit defining a second separate channel;

B. at least two transverse passages located axially spaced apart from each other for fluid communication with different ones of said separate channels; and C. at least one fluid-tight partition extending transversely between each said secondary conduit and the portion of said nozzle body located intermediate respective axially spaced-apart transverse passages to maintain a separation between different liquid fuels being introduced into said flow reversing fluid passage.

23. The nozzle assembly of claim 22 wherein each said fluid-tight partition comprises a resilient O-ring removably secured about the innermost end of said secondary conduit and adapted to make fluid-tight contact with said nozzle body.

24. In a fuel burner assembly comprising coaxial conduits that convey a liquid fuel and a fluent auxiliary medium in the same direction toward a combustion chamber, and means for combining and atomizing said liquid fuel with said auxiliary medium prior to introduction into said combustion chamber, an atomizing nozzle assembly comprising:

A. a nozzle body adapted for fluid-tight engagement with the axially innermost of said coaxial conduits, said nozzle body having an outer surface, at least one inlet port, at least one axially extended central bore communicating with said inlet port for transporting said liquid fuel therein a first direction, and at least one transverse passage fluidly connecting each said central bore and outer surface of said nozzle body and defining an acute tangent angle to the point of its emergence on the outer surface of said nozzle body for imparting a unidirectional spin to said liquid fuel exiting at said point of emergence;

B. a nozzle cap mounted on said nozzle body, and located distally with respect to said inlet port; and C. a flow reversing fluid passage in fluid registry with said at least one transverse passage and defined by said nozzle cap and the outer surface of said nozzle body adjacent to said at least one transverse passage for reversing the direction of flow of said liquid fuel from the direction of flow thereof with said bore, and said flow reversing fluid passage having an opening for the egress of said liquid fuel from said nozzle assembly such that the direction of travel of said liquid fuel emerging from said nozzle assembly is essentially opposite to that of a second, atomizing fluid, traveling adjacent said nozzle assembly, to provide a collision between said fuel and said atomizing fluid, resulting in improved atomization of said liquid fuel, at reduced emission velocities and fluid pressures.

25. The burner assembly of claim 24 wherein said nozzle assembly is mounted on the innermost of said conduits and said outermost conduit includes means for imparting a helical motion to the fluid traveling therein.

* * * * *